US005199240A

United States Patent [19]

Ewald, Jr.

[11] Patent Number: 5,199,240

[45] Date of Patent: Apr. 6, 1993

[54] BUILDING PANEL AND METHOD OF MAKING SAME

[76] Inventor: Herbert J. Ewald, Jr., 615 Avenue A., Karnes, Tex. 78118

[21] Appl. No.: 780,259

[22] Filed: Oct. 21, 1991

[51] Int. Cl.[5] ..... E04C 2/32

[52] U.S. Cl. ..... 52/814; 52/309.12

[58] Field of Search ..... 52/814, 415, 173 R, 52/309.9, 674, 309.12, 309.14

[56] References Cited

U.S. PATENT DOCUMENTS

| | | | |
|---|---|---|---|
| 2,426,943 | 9/1947 | Morden | 52/814 X |
| 3,732,138 | 5/1973 | Almog | 52/309.5 X |
| 3,783,563 | 1/1974 | Moore | 52/309.9 X |
| 4,206,267 | 6/1980 | Jungbluth | 52/309.14 X |
| 4,295,304 | 10/1981 | Kim | 52/309.9 X |
| 4,611,450 | 9/1986 | Chen | 52/309.12 X |
| 4,924,641 | 5/1990 | Gibbar, Jr. | 52/309.12 X |

FOREIGN PATENT DOCUMENTS

| | | | |
|---|---|---|---|
| 419390 | 3/1991 | France | 52/814 |
| 1196467 | 12/1985 | U.S.S.R. | 52/814 |

OTHER PUBLICATIONS

Dura Shield Brochure of Morrison Molded Fiber Glass Company, Bristol, Va.

Patent Specification Apr. 23, 1935 Brugier 450524.

*Primary Examiner*—David A. Scherbel

*Assistant Examiner*—Beth A. Aubrey

*Attorney, Agent, or Firm*—Vaden, Eickenroht, Thompson, Boulware & Feather

[57] ABSTRACT

There is disclosed a building panel and a method for forming same, wherein elongate rods of foamed plastic material are disposed within channels on opposite sides of a sheet of relatively rigid plastic material to a depth overlapping with rods in adjacent channels and layers of relatively rigid, plastic material are disposed over the outer faces of the rods and joined to the side walls of the channel so as to encapsulate the rods.

3 Claims, 4 Drawing Sheets

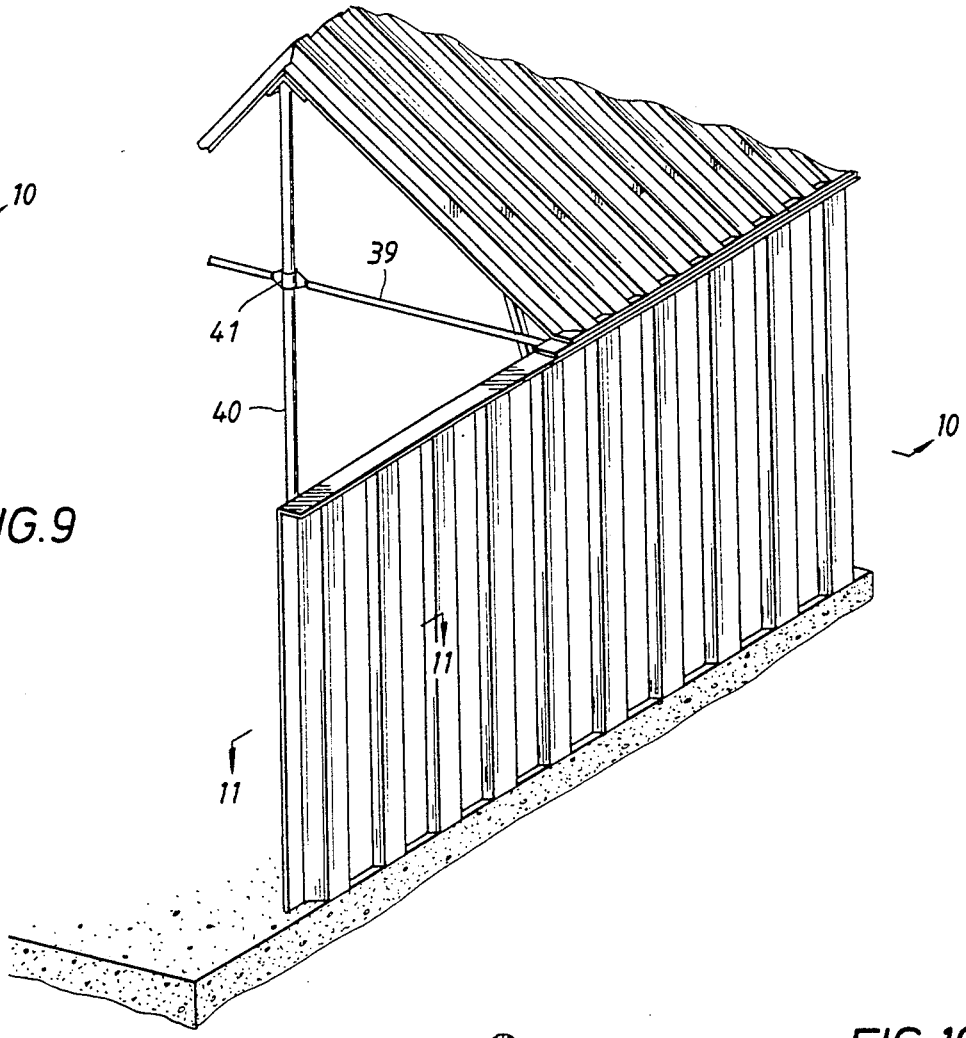
FIG. 9
FIG. 10
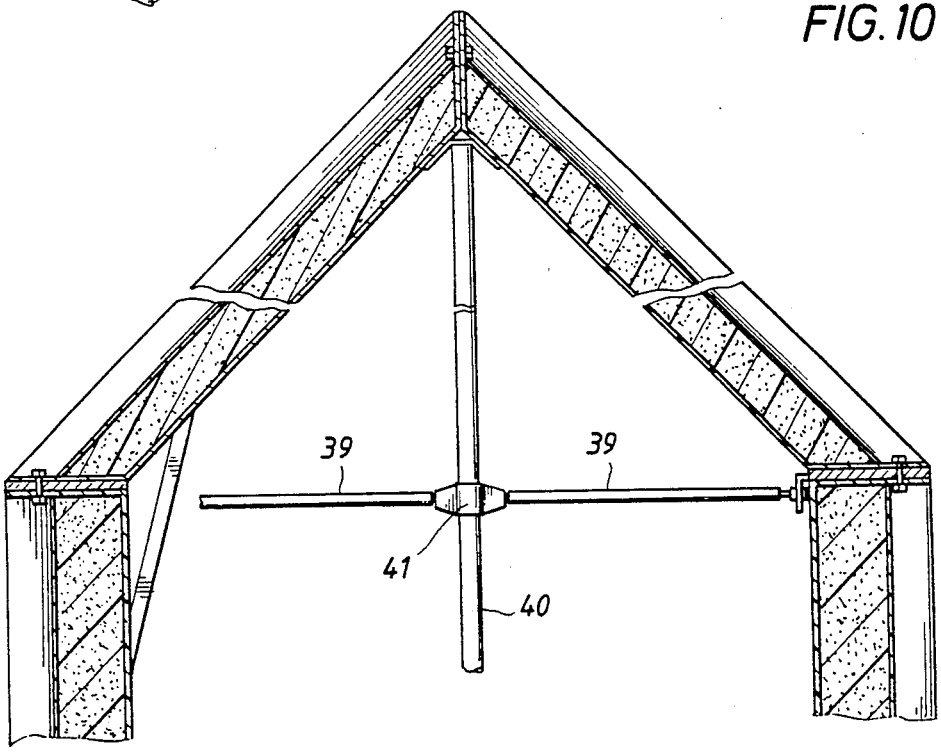

FIG.11
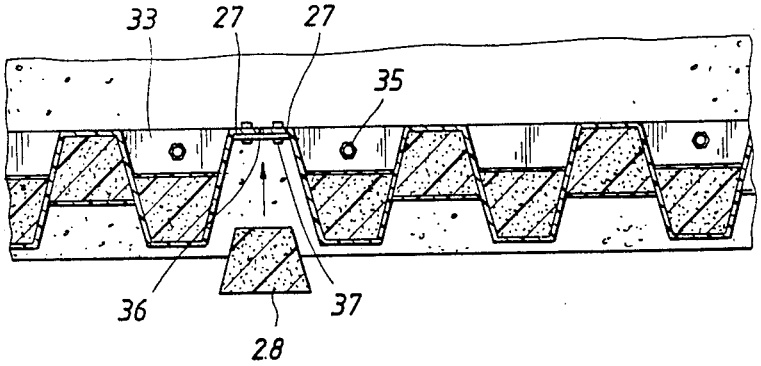
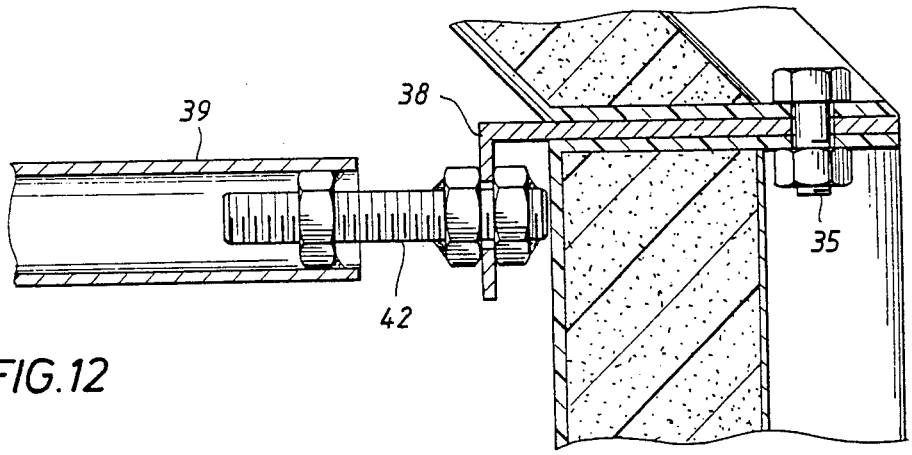
FIG.12
FIG.13
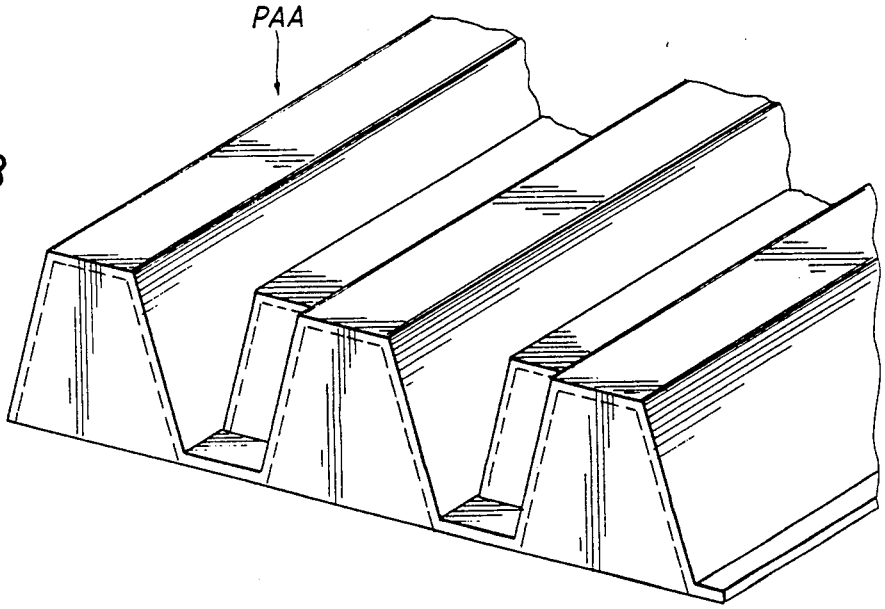

BUILDING PANEL AND METHOD OF MAKING SAME

This invention relates generally to building panels as well as a method of making such panels. More particularly, it relates to improvements in relatively light weight, inexpensive plastic building panels.

Although structural members are commonly made of relatively lightweight, inexpensive plastic materials, they seldom have both sufficient strength and insulating capacity, both thermal and sound, to permit them to be used as wall or roof panels for large buildings. Thus, although certain fiberglass reinforced resins are known to be structurally strong, they are relatively poor insulators. On the other hand, plastic material such as foamed plastic which are known to be good heat insulators do not provide the necessary structural support, either in compression or tension, to permit their use as building panels.

An object of this invention is to provide a relatively inexpensive and light weight building panel which is made of plastic materials so arranged as to have both such characteristics; and, more particularly, to provide such a panel which may be made without the need for either skilled labor or expensive equipment.

This and other objects are accomplished, in accordance with the illustrated embodiment of the invention, by a panel which includes a sheet of relatively rigid plastic material having first longitudinally extending, laterally spaced walls and second longitudinally extending, laterally spaced walls extending laterally between and connecting the side edges of adjacent first walls to form elongate channels on opposite sides of the sheet, elongate rods of foamed plastic material filling the channels to a depth at which they longitudinally overlap with rods in adjacent channels, and layers of relatively rigid, plastic material disposed over the outer faces of the rods and joined to the first walls of the sheet.

The relatively rigid sheet, which may be made, for example, of fiberglass reinforced resin, provides the panel with the necessary strength when loaded in the direction of the longitudinal channels, while the foamed plastic bodies provide both sound and heat insulation. Thus, even though relatively thin, the sheet is of such construction as to provide considerable strength as a beam or column, while at the same time providing a convenient enclosure for the rods of foamed plastic.

More particularly, the panel is made by a method which merely requires, in the way of equipment, a mold having at least one side conforming to one side of the sheet of the panel. Only unskilled labor is required to spray a suitable resin onto the one side of the mold to form the sheet, which, upon hardening, may be removed from the mold to permit the elongate rods of formed plastic material to be laid up in the channels on both sides of the sheet to the indicated depth. Then, additional resin may be sprayed over the outer faces of the rods and to the walls of the sheet forming the channel and hold them in place and protect them from the elements.

In the drawings, wherein like reference or characters are used throughout to designate like parts:

FIG. 9 is a perspective view of a portion of a building having side walls and a roof having panels constructed in accordance with the present invention;

FIG. 10 is a vertical sectional view of the building of FIG. 9 and showing, among other things, the securement of the roof to the upper ends of the side walls;

FIG. 11 is a horizontal sectional view of a portion of the side wall of the building, as seen along broken lines 11—11 of FIG. 9, and showing the manner in which the ends of adjacent panels are secured together and the channel formed between them filled with a rod of foamed material;

FIG. 12 is an enlarged sectional view of the joinder of the roof to the side wall of the building, together with the connection of one end of a tension rod to the side of the building; and FIG. 13 is a perspective view of a building panel of a modified construction used as part of the roof of the building.

Figure 1:
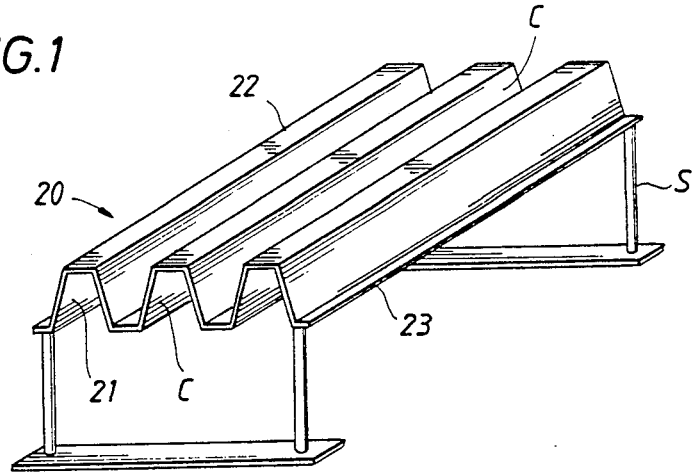
FIG. 1 is a perspective view of a mold for use in forming the sheet of the panel and supported above ground level with one side uppermost.
Figure 2:
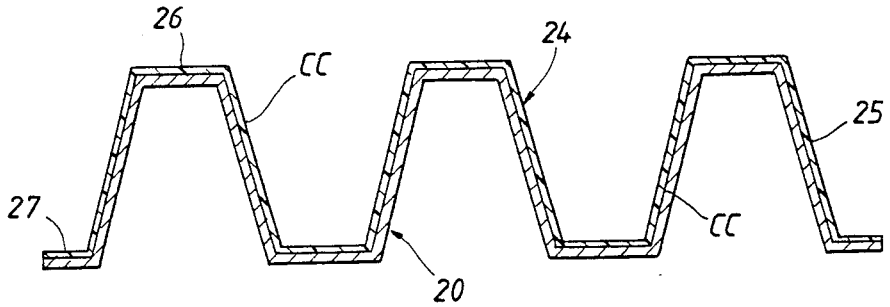
FIG. 2 is an enlarged cross-sectional view of the mold showing a layer of reinforced fiberglass sprayed onto one side thereof to form a relatively rigid sheet having conforming channels on its opposite sides.

With reference now to the details of the above-described drawings, the mold which is shown in FIG. 1, and indicated in its entirety by reference character 20, has first longitudinally extending, laterally spaced apart walls 21 and second longitudinally extending, laterally spaced walls 22 which extend between and are connected to and adjacent side walls to form elongate, laterally spaced channels C on the top and bottom sides of the mold. The mold may be of any suitable rigid material, such as lightweight metal and preferably has flanges 23 extending laterally from the outermost first walls. Preferably, and as shown, the walls 21 and 22 diverge at small angles from the bottom of each channel.

With the mold mounted in a generally horizontal position on a support above ground level, as shown in FIG. 1, reinforced fiber glass may be sprayed on to the top side thereof to which a parting agent has first been applied. When hardened, this thin layer of resin forms a relatively rigid sheet 24 of a shape conforming to the upper side of the mold. Thus, like the mold itself, the sheet 24 has longitudinally extending, laterally spaced first walls 25 and longitudinally extending, laterally spaced second walls 26 extending between and connecting adjacent first walls to form elongate channels CC on opposite sides thereof. In like manner, the fiberglass that is sprayed over the top sides of the flanges 23 of the mold forms laterally extending flanges 27 on the endmost first walls on one side of the sheet.

Figure 3:
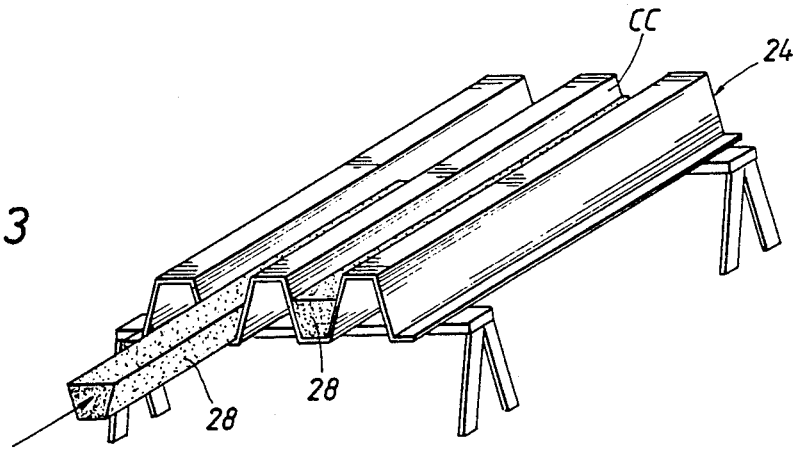
FIG. 3 is a perspective view of the molded sheet, upon removal of the mold, and during installation of rods of foamed plastic material within the channels in the top side of the sheet.

As shown in FIG. 3, the sheet 24 has been removed from the mold 20 and mounted on supports above ground level with one side uppermost. More particularly, rods 28 of foamed plastic material have been placed in the upwardly facing channels CC on the one side of the sheet, the left-hand rod being shown as it is installed longitudinally within the left-hand channel. These rods may of course be preformed at any suitable location and cut to the desired length to extend from one end to the other of the sheet. Preferably, and as illustrated, the cross-sectional shape of the rods conform to that of the channels so as to fit closely therein.

Figure 4:
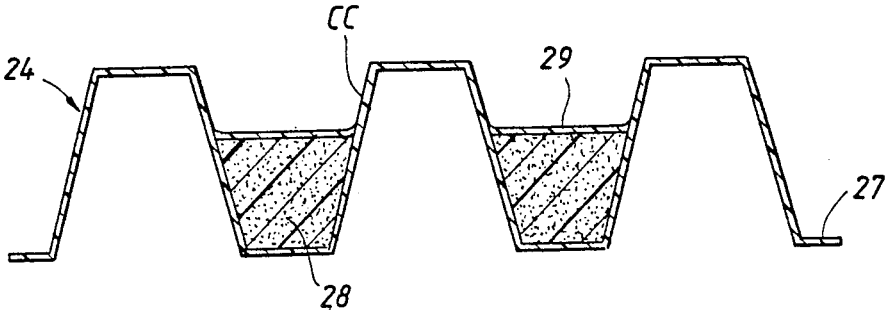
FIG. 4 is an enlarged cross-sectional view of the sheet, with layers of reinforced fiberglass sprayed over the top of the rods and to the sides of the channel to encapsulate the rods.
Figure 5:
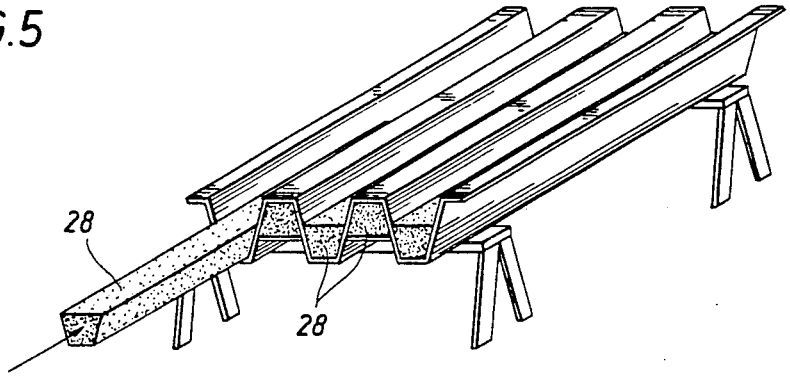
FIG. 5 is a perspective view of the sheet shown in FIG. 4, but upon being turned upside down, and with rods being installed in channels on the upper side of the sheet.

As shown in FIG. 4, layers 29 of reinforced fiber glass material have been sprayed over the upper sides of rods 28 and to the adjacent sides of the channels CC to encapsulate the rods 28 within the channels. Upon hardening of the layers 28, the sheet is inverted and installed on a support above ground level, as shown in FIG. 5. At this time, additional rods 28 are installed in the upwardly facing channels of the sheet, the left-hand rod being shown as it is being moved longitudinally into the left-hand channel.

More particularly, the rods 28 are of such thickness that the rods in adjacent channels longitudinally overlap one another. Thus, in the completed building panel, the side of each rod overlaps throughout its length with the side of a rod in the adjacent channel, thus providing a continuous insulating barrier across the width of the formed panel.

Figure 6:
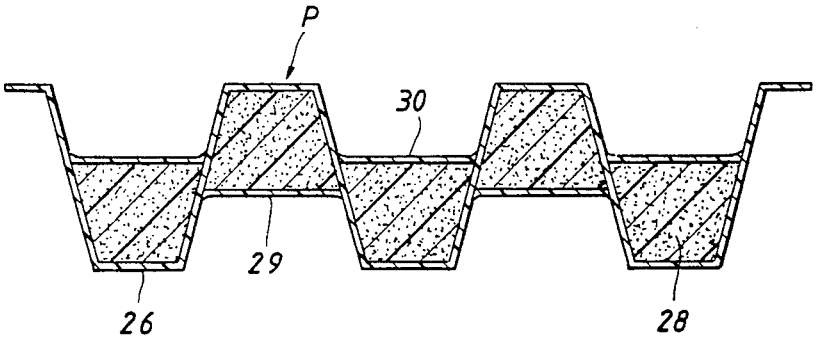
FIG. 6 is an enlarged cross-sectional view of the sheet showing layers of reinforced fiberglass sprayed over the tops of the rods and adhered to the sides of the upstanding channels to form a panel.

As shown in FIG. 6, layers 30 of reinforced fiber glass are sprayed over the upper sides of the rods 28 and to the side walls forming adjacent channels, thus encapsulating the rods installed in such channels. Upon hardening of the layers, the building panel may be removed from its support for installation.

The modified mold 20A is also made of longitudinally extending, laterally spaced apart first walls 21A and longitudinally extending, laterally spaced apart second walls 22A extending between and connected to the longitudinal edges of first walls 21A, thus forming channel C on both sides of the mold as in the case of mold 20. However, the mold 20A also includes flaps 31 hingedly connected to each end of the mold. More particularly, and as shown in FIG. 7, each flap is hingedly connected to the second walls and flanges adjacent the lower side of the mold, as shown in FIG. 7.

Figure 7:
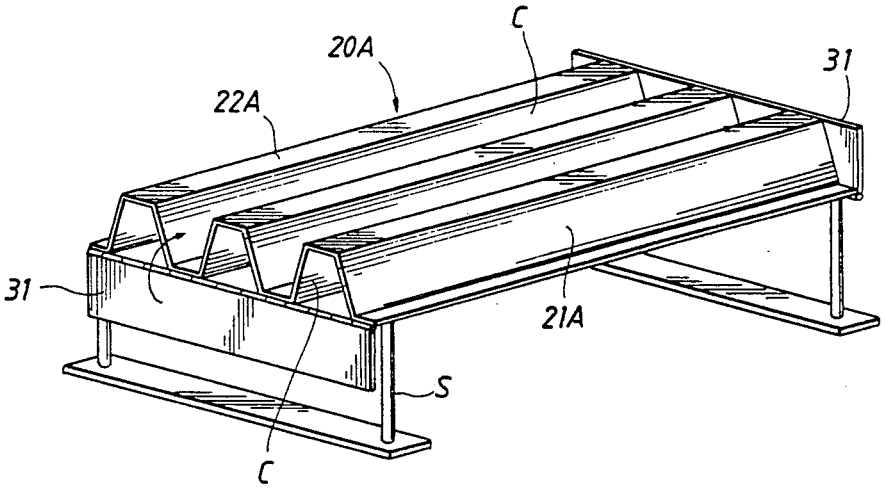
FIG. 7 is a perspective view of a modified embodiment of a mold having flaps hingedly connected to its opposite ends.
Figure 8:
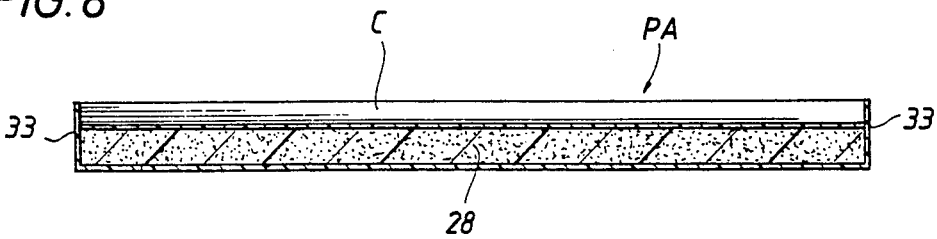
FIG. 8 is a longitudinal sectional view of a building panel formed with end walls with the use of the mold of FIG. 7.

In using the mold 20A, the flaps are folded upwardly, as shown by the right-hand flap 31 of FIG. 7, so as to form the panel PA of FIG. 8 having end walls 33 across each end of the channels C. Thus, the flaps 31 are of the same height as the channels of the mold, so that when swung upwardly to the position shown in FIG. 7, they permit reinforced fiber glass to be sprayed over the inner sides of the flaps to form the end walls 33. This then encapsulates the ends as well as the upper sides of the rods 28 of foamed plastic. As will be described to follow, a portion of the end wall 33 which is not covered by the end of a rod provides a portion which may be used in the assembly of the panels in the construction of a building.

The building shown in FIG. 9 has side walls comprising edge-to-edge panels installed in upright positions on the upper surface of a slab, and additional edge-to-edge panels forming a roof truss whose lower ends are connected to the tops of the side walls. As shown in FIG. 10, flanges 27 on the ends of the panels provide means by which the lower ends of the side wall panels adjacent panels of the roof and side walls may be secured to one another by bolts 35 or the like through portions 33 of the end walls.

As shown in FIG. 11, the uncovered portions of end walls 33 of the panels are secured to the slab by bolts 35, and the flanges 27 on adjacent panels are secured to one another by an overlapping plate 36 and bolts 37 extending through them. With the adjacent panels so secured, another rod 28 of foamed plastic material may be installed within the channel formed between the outermost side walls of the adjacent panels. More particularly, like the other rods 28, this rod is of such configuration that, when installed, it overlaps with the rods of adjacent channels of the adjacent panels. When the rod is so installed, it will then be covered with a layer (not shown) of reinforced plastic material, as is the case of the rods of the formed panels.

As shown in FIGS. 9 and 10, a pole 40 supported on the slab supports the peak of the roof truss. Also, as shown in FIG. 12, an angle 38 is bolted between the end walls of the panels of the side walls and roof truss, and a tension rod 39 is connected at each end to the flange and at the other end to a bracket 41 on pole 40 to hold the side walls against collapse. The length of the end rod is adjustable by means of nuts on opposite sides of a threaded bolt 42 received to the flange of the angle and another nut on the bolt fixed to the inside of the rod.

The panel PA shown in FIG. 13 is especially adapted for use in forming the roof truss in that the rods and layers in the channels on its upper side of the panel have tapered ends to facilitate runoff from the top of the roof.

From the foregoing it will be seen that this invention is one well adapted to attain all of the ends and objects hereinabove set forth, together with other advantages which are obvious and which are inherent to the method and apparatus.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. A panel, comprising a sheet of relatively rigid plastic material having longitudinally extending, laterally spaced first walls and longitudinally extending, laterally spaced second walls extending between and connecting adjacent first walls to form elongate, oppositely facing channels, elongates rod of foamed plastic material filling the channels to a depth at which they longitudinally overlap with rods in adjacent channels, and layers of relatively rigid, plastic material disposed over and onto the outer faces of the rods and joined to the first and second walls of the channel in which the rods are disposed.

2. As in claim 1, including additional layers of relatively rigid, plastic material disposed over and onto the opposite ends of the rods and joined to the first and second walls of the sheet to form walls.

3. As in claim 1, including the sheet includes flanges extending laterally from the free edges of the outermost first walls.

* * * * *